US011457726B2

(12) United States Patent
Wallis

(10) Patent No.: US 11,457,726 B2
(45) Date of Patent: Oct. 4, 2022

(54) STOWABLE WORKSTATIONS

(71) Applicant: Werxco Pty Ltd, Taren Point (AU)

(72) Inventor: Greg Wallis, Taren Point (AU)

(73) Assignee: WERXCO PTY LTD, Taren Point (AU)

( * ) Notice: Subject to any disclaimer, the term of this patent is extended or adjusted under 35 U.S.C. 154(b) by 0 days.

(21) Appl. No.: 17/744,073

(22) Filed: May 13, 2022

(65) Prior Publication Data

US 2022/0273094 A1 Sep. 1, 2022

Related U.S. Application Data

(63) Continuation of application No. PCT/AU2021/050518, filed on May 28, 2021.

(30) Foreign Application Priority Data

May 29, 2020 (AU) ..... 2020901764
Oct. 21, 2020 (AU) ..... 2020903809

(51) Int. Cl.
*A47B 3/00* (2006.01)
*A47B 21/03* (2006.01)

(52) U.S. Cl.
CPC ..... *A47B 3/00* (2013.01); *A47B 21/03* (2013.01); *A47B 2200/0001* (2013.01); *A47B 2200/0036* (2013.01)

(58) Field of Classification Search
CPC .... A47B 5/00; A47B 5/06; A47B 3/00; A47B 21/03; A47B 2200/0036
USPC ..... 108/35, 36, 37, 33, 40, 41
See application file for complete search history.

(56) References Cited

U.S. PATENT DOCUMENTS 1,699,496 A * 1/1929 Wasmuth ..... A47B 5/06 108/63
1,909,093 A * 5/1933 Buffelen ..... D06F 81/06 108/116
2,264,678 A * 12/1941 Pryne ..... D06F 81/06 108/139
2,646,331 A * 7/1953 Gallo ..... A47B 63/04 312/317.3
2,897,030 A * 7/1959 Ficarella ..... A47B 27/00 312/231

(Continued)

FOREIGN PATENT DOCUMENTS

JP 2009273584 A * 11/2009
WO 2011005182 A1 1/2011
WO 2021119609 A1 6/2021

OTHER PUBLICATIONS

International Preliminary Report on Patentability (Chapter II) dated Apr. 8, 2022 from corresponding PCT Application No. PCT/AU2021/050518.

(Continued)

*Primary Examiner* — Jose V Chen
(74) *Attorney, Agent, or Firm* — Innovation Capital Law Group, LLP; Vic Lin

(57) ABSTRACT

Stowable workstations are provided which have back, top and front panels and side pillars and are configurable in a stowed configuration wherein the panels and side pillars form a rectangular enclosure and which can transition to a deployed configuration wherein the front panel extends horizontally to form a desk surface.

19 Claims, 6 Drawing Sheets

(56) References Cited

U.S. PATENT DOCUMENTS 3,062,544 A * 11/1962 Viets ..... A63B 67/04 108/166
3,866,547 A * 2/1975 Guyton ..... A47B 5/06 108/38
4,669,789 A 6/1987 Pemberton
4,829,910 A * 5/1989 Lirette ..... A47B 83/045 108/35
5,622,119 A * 4/1997 Hsieh ..... A47B 3/00 108/115
5,669,314 A * 9/1997 Grant ..... A47B 5/00 108/20
6,161,486 A * 12/2000 Boots ..... B25H 1/04 297/14
7,131,155 B1 * 11/2006 Fernandez ..... A47D 5/003 5/655
8,205,564 B2 * 6/2012 St. Louis ..... B64D 11/06 108/147
8,365,676 B1 * 2/2013 McAuliff ..... A47B 5/06 108/48
8,662,605 B2 * 3/2014 McRorie ..... A61B 50/13 108/50.01
8,763,537 B2 * 7/2014 Ng ..... A47B 3/083 297/331
9,723,919 B1 8/2017 Randolph et al.
2003/0047120 A1 * 3/2003 Dettmers ..... A47B 9/16 108/42
2006/0119237 A1 6/2006 Packer
2007/0227407 A1 * 10/2007 Cartensen ..... B61D 37/006 108/33
2008/0041279 A1 * 2/2008 Johnson ..... A47B 31/04 108/35
2008/0190329 A1 * 8/2008 Boyd ..... A47B 3/04 108/143
2009/0039743 A1 2/2009 Gevaert
2010/0236454 A1 * 9/2010 Parizek ..... A47B 3/10 108/38
2011/0000404 A1 * 1/2011 Lauther ..... A47B 5/06 62/457.7
2012/0086316 A1 * 4/2012 Schaaf ..... A47B 81/00 312/265.5
2012/0212116 A1 8/2012 McRorie et al.
2012/0242204 A1 9/2012 Boyer

OTHER PUBLICATIONS

International Search Report & Written Opinion dated Aug. 13, 2021 from corresponding PCT Application No. PCT/AU2021/050518.

* cited by examiner

STOWABLE WORKSTATIONS

FIELD OF THE INVENTION

This invention relates generally to workstations and, more particularly, this invention relates to stowable workstations.

BACKGROUND

Various forms of stowable workstations exist including US 2012/0212116 A1 (MCRORIE et al.) 23 Aug. 2012 [hereinafter referred to as D1] which discloses a mobile technology cabinet comprises a compartment having a work platform mounted for rotational motion between a substantially vertical storage position and a deployed position.

US 2012/0086316 A1 (SCHAAF) 12 Apr. 2012 [hereinafter referred to as D2] discloses a portable station has an open enclosure and a chest having first and second cases pivotally coupled to each other.

US 2012/0242204 A1 (BOYER) 27 Sep. 2012 [hereinafter referred to as D3] discloses beauty station formed as a cabinet adapted to be hung on a wall, the cabinet comprising a main structural frame generally shaped as a box having side walls, a top wall, a bottom wall, a back wall, and a front wall defining an interior space.

US 2009/0039743 A1 (GEVAERT) 12 Feb. 2009 [hereinafter referred to as D4] worksurface storage system includes a frame, a tray, an actuator, and a cover. The tray and actuator are connected to the frame such that operation of the actuator translates the actuator and the tray relative to the frame.

WO 2011/005182 A1 (MARINE LEISURE SWEDEN AB) 13 Jan. 2011 [hereinafter referred to as D5] discloses furniture for computer-related work, which has side walls which are connected with an upper connecting device as well as with a relieving plate, an opening being formed between the side walls, the top and the relieving plate, and two doors which are mounted at the opening, arranged to co-operate from the front to entirely close said opening.

A need exists for a stowable workstation which will overcome or substantially ameliorate at least some of the deficiencies of the prior art, or to at least provide an alternative.

SUMMARY OF THE DISCLOSURE

According to a first aspect shown in FIGS. 1-8, there is provided a stowable workstation comprising: back, top and front panels, side pillars and a carriage traveling vertically between the side pillars, wherein the workstation: is configurable in a stowed configuration wherein: the panels and side pillars form a rectangular enclosure; the carriage is at a lower position within the enclosure and the front panel is vertical; and which transitions to a deployed configuration wherein the: the top panel is moved away from a top of the enclosure to expose an opening into the enclosure; the carriage moves vertically between the side pillars to hoist workstation equipment through the opening; and the front panel pivots outwardly; such that, in the deployed configuration: the carriage is substantially at the top of the enclosure; the front panel extends horizontally from the top of the enclosure to form a desk surface.

As such, the workstation may assume a small form compact and secure configuration shown in FIG. 1 deployed to an ergonomic workstation shown in FIG. 7. Extendable legs may further allow sitting or standing configurations when in the deployed configuration as is further shown in FIG. 8.

In the stowed configuration, the workstation may define an upper height limit and, in the deployed configuration, the workstation may not exceed the upper height limit, apart from the workstation equipment which pops up through an opening of the enclosure.

Furthermore, the carriage may comprise a horizontal carriage panel which, in the deployed configuration is substantially flush with the desk surface and may reduce or eliminate gaps therebetween to effectively extend the effective desk surface area.

The front panel forming the desk surface is raised from between the side pillars in the deployed configuration, thereby effectively increasing legroom through a front of the workstation. Furthermore, in the standing configuration shown in FIG. 8, the back panel is also raised away from between the extendable legs, thereby allowing space through a rear of the workstation.

When transitioning to the deployed configuration, the front panel may travel upwardly carriage and pivot downwardly. The front panel may be restricted from providing downwardly until the carriage is substantially at the upper position.

Flat side supports may fold outwardly to support the front panel against the side pillars.

Unlike the arrangement of D1, the present workstation is not overly tall wherein the top panel moves out of the way to allow the workstation equipment to pop up from an opening of the enclosure. Further unlike the arrangement of D4, the front panel forms part of the enclosure in the stowed configuration and forms the desk in the deployed configuration, thereby being more compact, requiring fewer panels and moves the front panel out of the way in the deployed configuration for increased legroom.

According to a further aspect shown in FIGS. 9-12, there is provided a stowable workstation comprising: a back, top and front panels and side pillars; the side pillars comprising a traveling upper portion and a fixed lower portion wherein the workstation is configurable: in a stowed configuration wherein: the panels and side pillars form a rectangular enclosure; the traveling upper portions are at a lower position; and the front panel is vertical and transitions to a deployed configuration wherein: the upper portions move vertically with respect to the fixed lower portions; and the front panel pivots outwardly, such that, in the deployed configuration; the traveling upper portions are at an upper position; the front panel extends horizontally from the upper and lower portions to form a desk surface and the top and back panels and upper portions define an open cabinet above the desk surface.

As such, the workstation may form the small form compact and secure configuration shown in FIG. 10 yet deployable to the ergonomically usable configuration shown in FIGS. 11 and 12 wherein the workstation defines a cabinet formed between the top panel and the upper portions and wherein the cabinet is formed above the desk surface for workstation equipment.

The front panel may be supported by front panel support legs which lie flat against an outer surface of the front panel in the stowed configuration in which extend orthogonally with respect to the front panel in the deployed configuration.

The front panel support legs may be pivotally coupled by an arrangement of pivot points and braces so that, as the front panel pivots downwardly, the legs pivot orthogonally with respect to the front panel.

Unlike the arrangement of D2, the top and back panels and upper portions of the side pillars define an open cabinet above the desk surface. Further unlike D2, in the deployed configuration, the front panel is raised away from between the lower portions of the side pillars, thereby allowing leg space through front of the workstation. The back panel may also be raised away from between the lower portions of the side pillars, thereby allowing space through a rear of the workstation.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
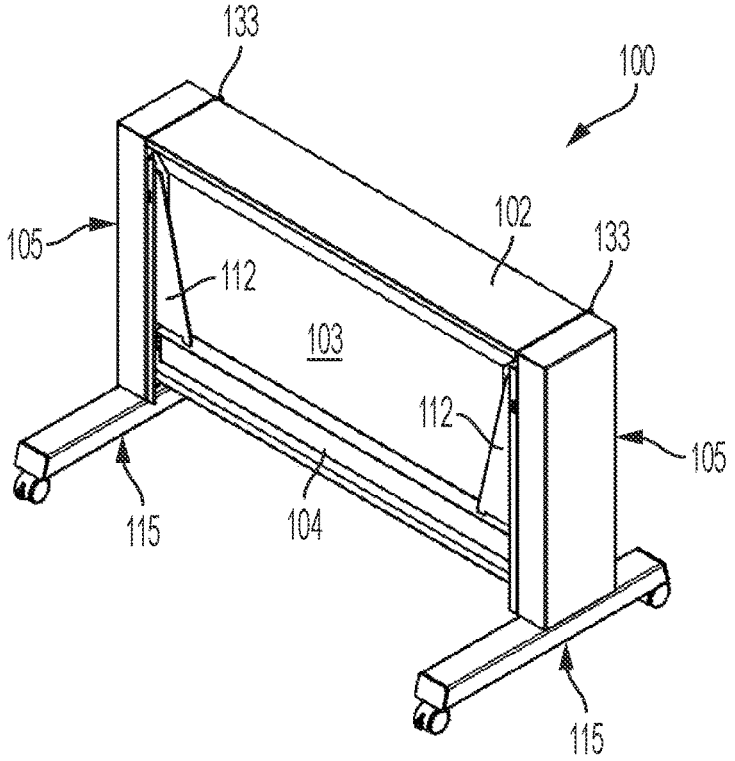
FIG. 1 shows a perspective view of a workstation in accordance with a first embodiment in a stowed configuration.

A stowable workstation 100 comprises a back panel 101, a top panel 102, a front panel 103, side pillars 105 and a carriage 104 traveling vertically between the side pillars 105.

Figure 3:
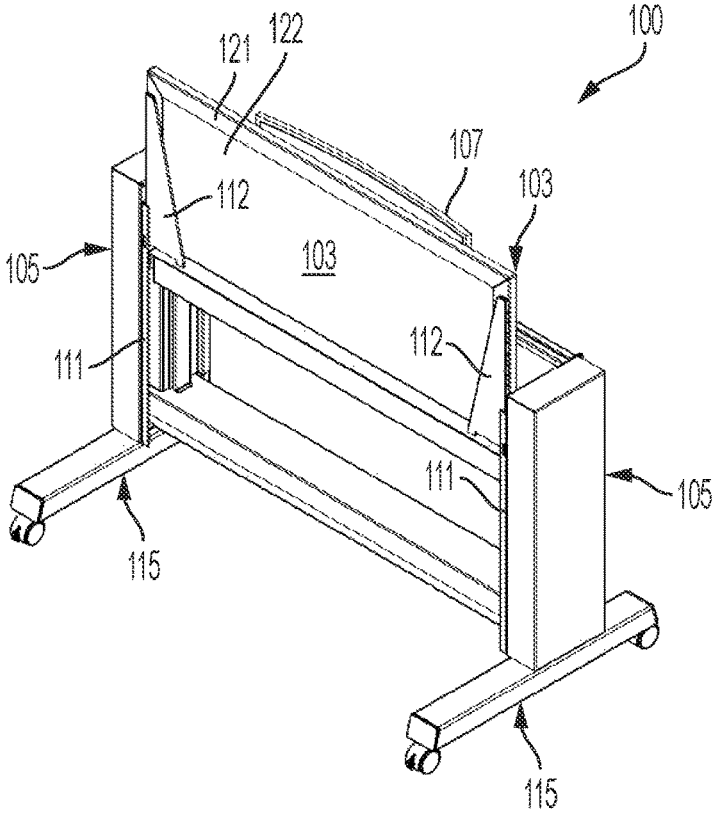

With reference to FIG. 3, the front panel 103 may comprise a structural outer frame 121 and an inlaid panel 122. The outer structural frame 121 may be metallic whereas the inlaid panel 122 may be wooden.

FIG. 1 shows the workstation 100 in a stowed configuration wherein the panels 101, 102 and 103 form a rectangular enclosure concealing workstation equipment therein. The workstation equipment may comprise a display stand or arm 106 for a flat panel digital display 107 or the like.

In the stowed configuration, the carriage 104 is at a lower position within the enclosure and the front panel 103 is vertical.

Figure 5:
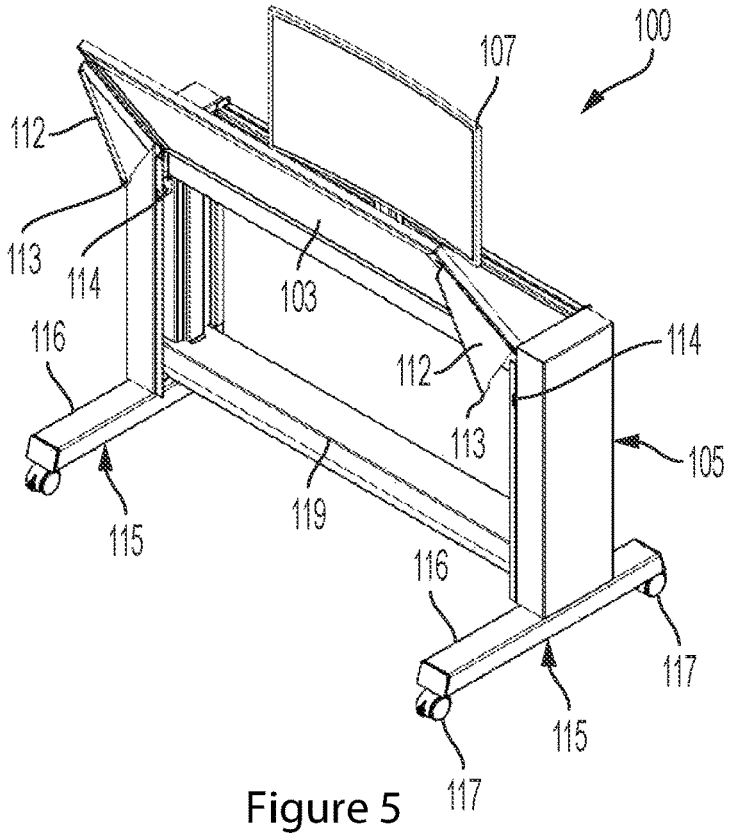
Figure 6:
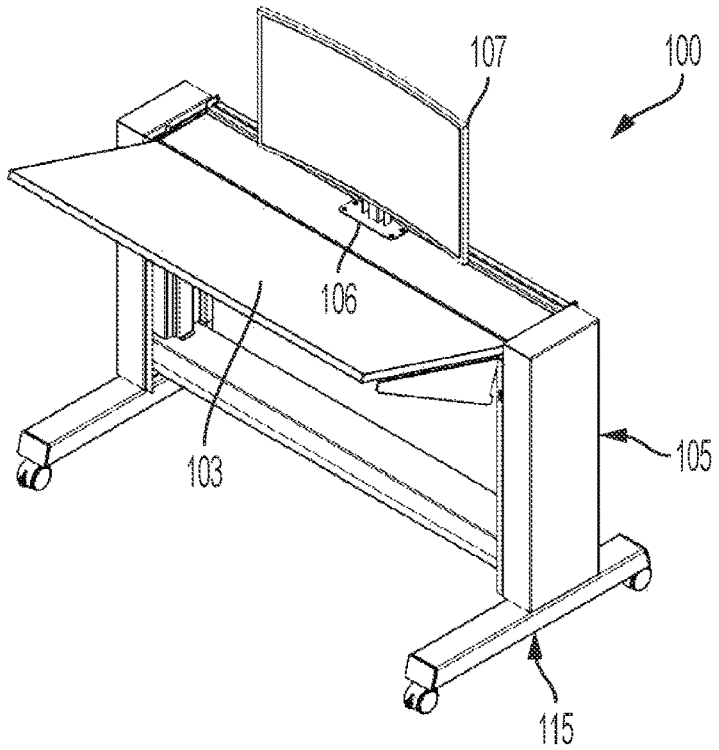
Figure 7:
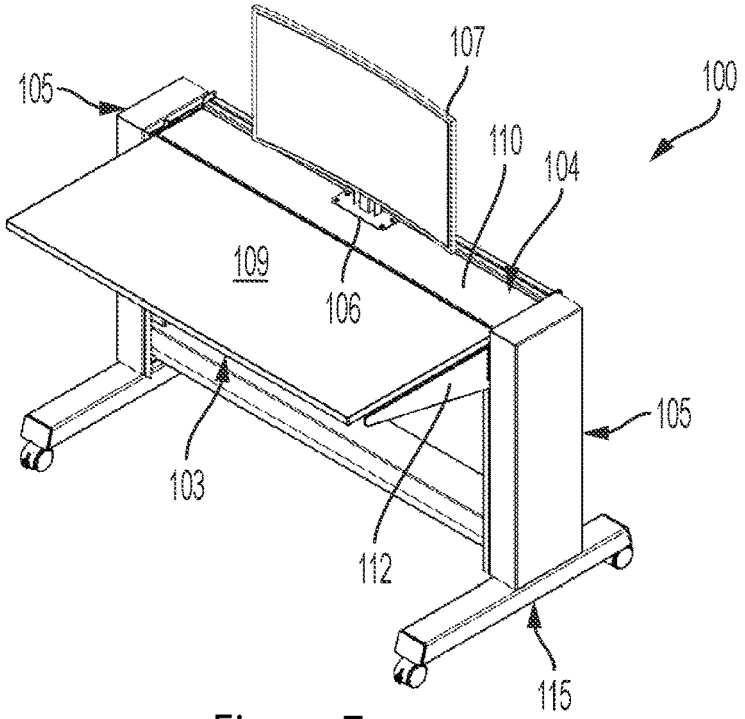
FIG. 7 shows a perspective view of the workstation of FIG. 1 in a deployed configuration.

FIGS. 2-6 illustrate the workstation 100 transitioning to a deployed configuration shown in FIG. 7.

Figure 2:
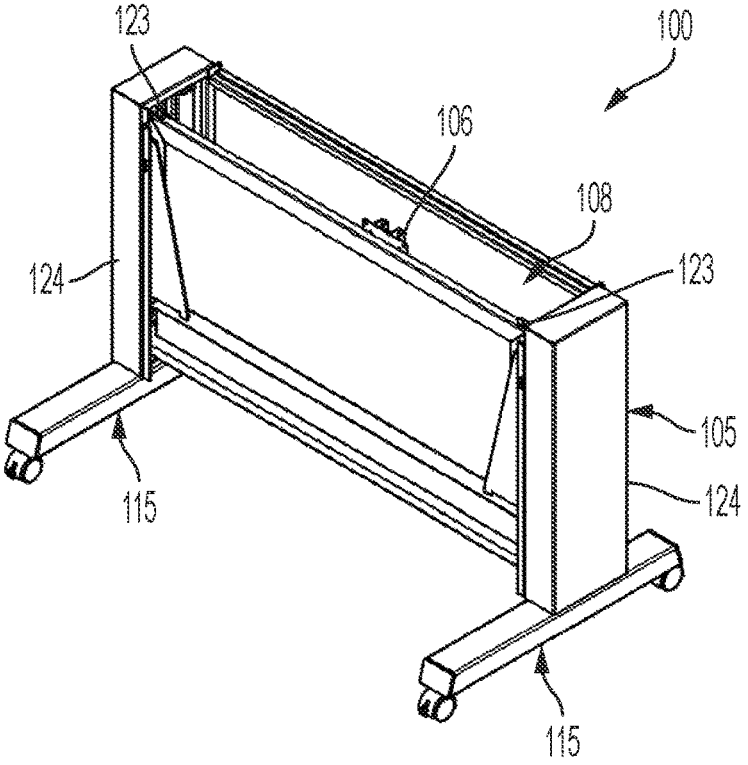
FIGS. 2-6 show perspective views of the workstation of FIG. 1 transitioning to a deployed configuration.
Figure 4:
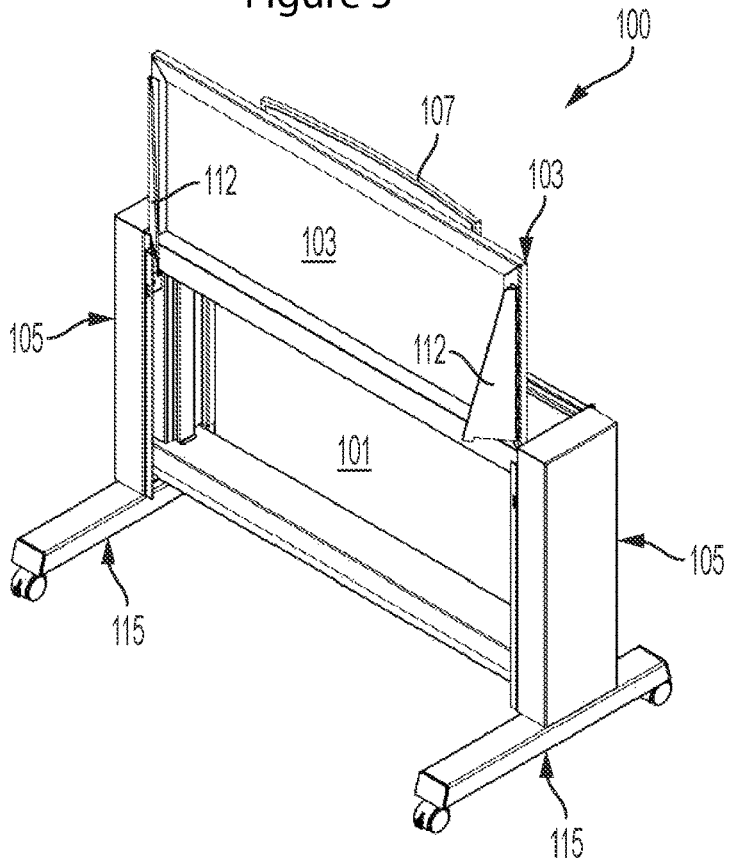

FIG. 2 shows how the top panel 102 is moved away from a top of the enclosure to expose an opening 108 into the enclosure. FIGS. 3-5 illustrate how the carriage 104 moves vertically between the side pillars 105 to hoist the workstation equipment through the opening 108.

The top panel 102 may be pivotally coupled to the back panel 101 or the side pillars 105 by hinges so that the top panel 102 folds over the back of the workstation to lie flat against the back panel.

FIGS. 5 and 6 illustrate how the front panel 103 pivots outwardly to form a horizontal desk surface 109.

As is illustrated in FIG. 7, in the deployed configuration, the carriage 104 is at or near a top of the enclosure and the front panel 103 extends horizontally from a top of the enclosure to form the horizontal desk surface 109.

The workstation 100 may define an upper height limit in the stowed configuration and, in the deployed configuration, the workstation 100 may not exceed the upper height limit, apart from the workstation equipment which pops up through the opening of the enclosure.

As is shown in FIG. 7, the carriage 104 may comprise a carriage panel 110 which, in the deployed configuration, is substantially flush with the desk surface 109 and may leave less than a 2 cm gap from a rear edge of the front panel thereby effectively extending the effective desk surface area.

As is illustrated in FIGS. 3 and 4, when the workstation 100 transitions to the deployed configuration, the front panel 103 may move up with the carriage 104 and pivot downwardly.

The front panel 103 may be restrained from pivoting downwardly until the carriage is substantially at the upper position. As is shown in FIG. 4, the side pillars may support side rails 111 which engage an outer surface of the front panel 103 to hold the front panel 103 vertical. Upper ends of the side rails 111 may terminate short of an upper position of the front panel 103, thereby freeing the front panel 103 to pivot downwardly in the manner shown in FIG. 5.

The workstation 100 may comprise flat sides supports 112 which, as is shown in FIG. 1, lie flat in against an outer surface of the front panel 103 in the stowed configuration. However, as is illustrated in FIGS. 4 and 5, the side supports 112 may fold outwardly to be orthogonal to an undersurface of the front panel 103 in the deployed configuration to brace against respective side pillars 105 to support the front panel 103 horizontally.

As shown in FIG. 5, the side supports 112 may comprise projections 113 which slot into corresponding slots 114 of the side pillars 105.

The workstation 100 may comprise side latches 123 configurable in a locked position wherein the leaches 123 catch against a top edge of the front panel 103, thereby preventing the raising of the front panel 103. To deploy the workstation 100, the latches 123 may be pivoted to an open position with either hand to free the front panel 103.

The side pillars 105 may comprise a rectangular housing 124 concealing gas struts therein which hoist the carriage 104. The gas struts may act on 2:1 pulley gearing to allow for shorter gas struts within the height restriction of the confines of the rectangular housing 124.

The side pillars 105 may be supported by feet 115. The feet 115 may comprise parallel horizontal bars 116 supported by lockable castor wheels 117 at either end thereof.

Figure 8:
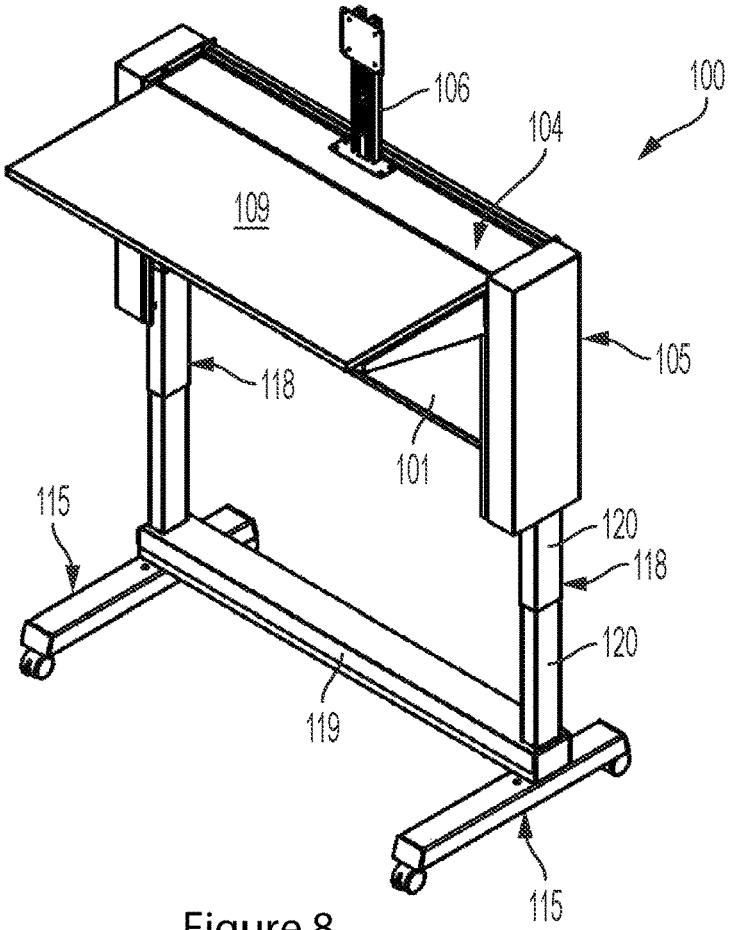
FIG. 8 shows a perspective view of the workstation of FIG. 1 further in a standing configuration in accordance with a further embodiment.

With reference to FIG. 8, the workstation 100 may further comprise extendable legs 118 operative between the side pillars 105 and the feet 115. As such, in the deployed configuration, the workstation 100 is further configurable in a seated configuration shown in FIG. 7 wherein the desk surface 109 is at a seated position and a standing configuration shown in FIG. 8 when the desk surface 109 is at a standing position higher than seated position.

The extendable legs 118 may comprise telescopic portions 120 with a linear actuator acting therebetween. The linear actuator may comprise an electromechanical screw drive actuator for electronic control of the position of the desk surface 109.

The workstation 100 may comprise a cross brace 119 between lower ends of the legs 118. The cross brace 119 may be hollow to accommodate control equipment and/or batteries therein for operation of the extendable legs 118.

FIGS. 9-12 show a workstation 125 in accordance with a further embodiment wherein the workstation 125 comprises a back panel 101, top panel 102 and a front panel 103. The workstation 125 further defines side pillars 105 which, with reference to FIG. 11 each comprise a traveling upper portion 126 and a fixed lower portion 127.

Figure 9:
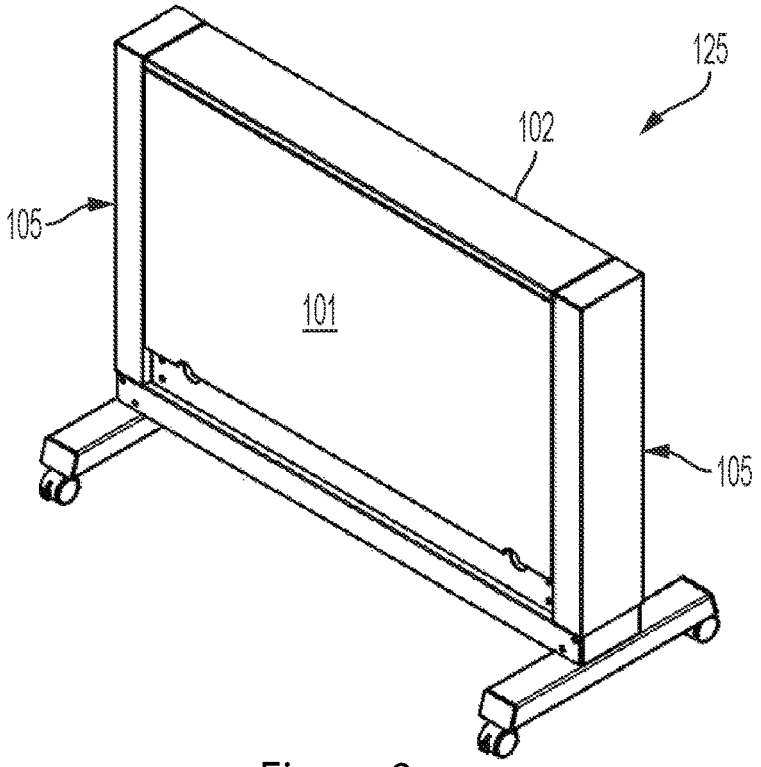
FIG. 9 shows a rear perspective view of a workstation in accordance with a yet further embodiment.
Figure 10:
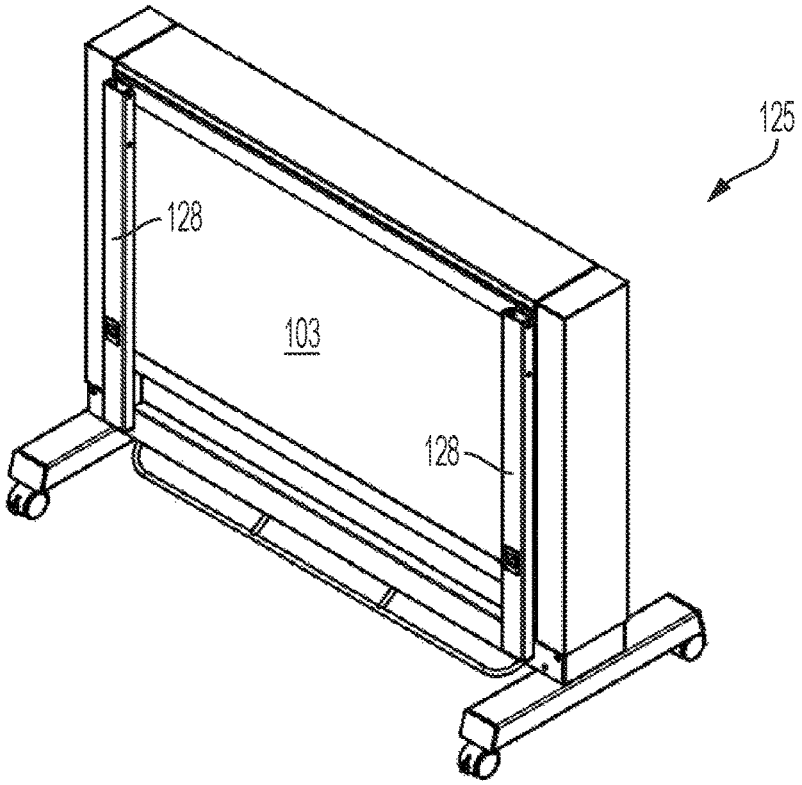
FIG. 10 shows a front perspective view of the workstation of FIG. 9.

In a stowed configuration shown in FIGS. 9 and 10, the panels 101, 102 and 103 form a rectangular enclosure wherein the traveling upper portions 105 are at a lower position and the front panel 103 is vertical.

Figure 11:
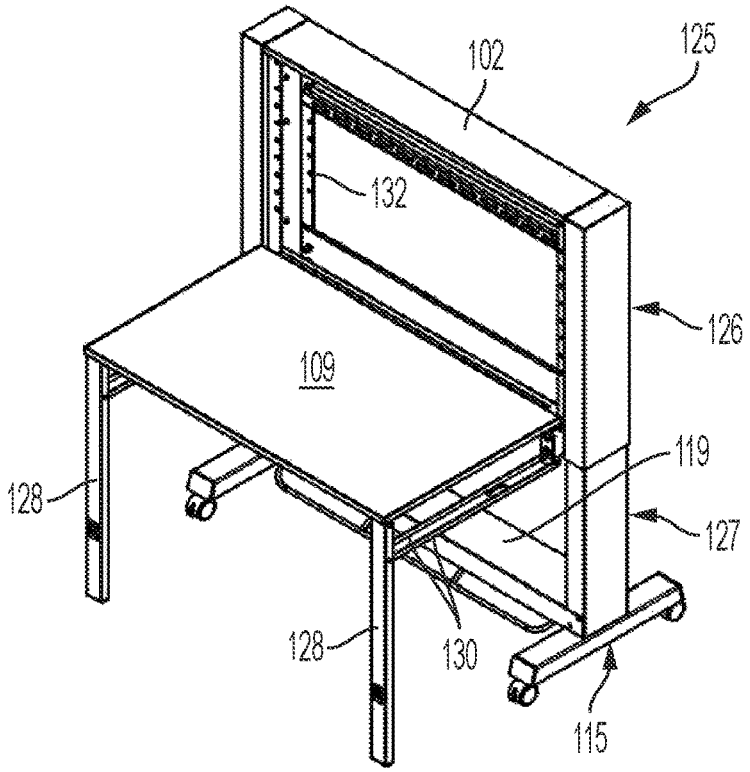
FIG. 11 shows a perspective view of the workstation of FIG. 9 in a deployed configuration.
Figure 12:
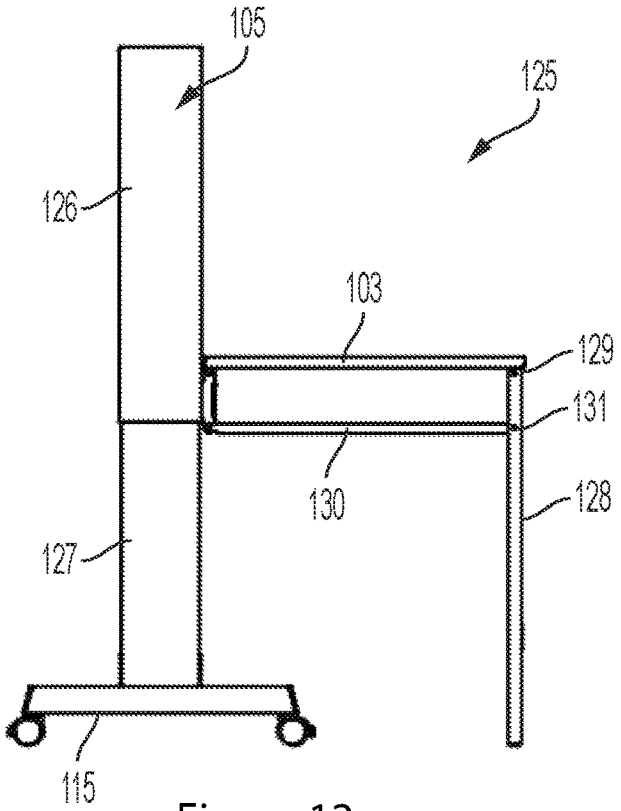
FIG. 12 shows a side elevation view of the workstation of FIG. 9 in the deployed configuration.

When the workstation 125 transitions to a deployed configuration shown in FIGS. 11 and 12, the upper portions 126 move vertically with respect to the fixed lower portions 127 and the front panel 103 pivots outwardly.

As such, in the deployed configuration, the traveling upper portions 126 are at an upper position and the front panel 103 extend horizontally from the upper and lower portions to form a desk surface 109.

In the deployed configuration, the top and back panels 102 and 101 and upper portions 126 define an open cabinet above the desk surface 109 for workstation equipment. The cabinet may comprise various attachment brackets 132 therein for attachment of various workstation equipment, such as flat screen displays, shelves, receptacles and the like.

In a similar manner, the front panel 103 may travel upwardly with the upper portions 126 and pivot downwardly to form the desk surface 109.

The workstation 125 may further comprise front panel support legs 128 which lie flat against an outer surface of the front panel 103 in the stowed configuration shown in FIG. 10 and extend orthogonally with respect to the front panel 103 in the deployed configuration shown in FIGS. 11 and 12 to support the front panel 103.

The support legs 128 may be pivotally coupled from the front panel by a distal pivot 129 and pivotally coupled by braces 130 at a proximal pivot point 131. The pivot points 129 and 131 and the braces 130 may be configured so that, as the front panel 103 pivots downwardly, the legs 128 pivot orthogonally with respect to the front panel.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. A stowable workstation comprising:

back, top and front panels, side pillars and a carriage travelling vertically between the side pillars, wherein the workstation:

is configurable in a stowed configuration wherein:

the panels and side pillars form a rectangular enclosure;

the carriage is at a lower position within the enclosure; and the front panel is vertical, and transitions to a deployed configuration wherein:

the top panel is configured to move away from a top of the enclosure to expose an opening into the enclosure;

the carriage is configured to slide vertically between the side pillars to hoist workstation equipment through the opening;

the front panel is configured to travel up with the carriage; and the front panel is configured to pivot outwardly;

such that, in the deployed configuration:

the carriage is substantially at the top of the enclosure;

the front panel extends horizontally from the top of the enclosure to form a desk surface.

2. The workstation as claimed in claim 1, wherein the workstation defines an upper height limit in the stowed configuration and, in the deployed configuration, the workstation does not exceed the upper height limit, apart from the workstation equipment which extends up through the opening.

3. The workstation as claimed in claim 1, wherein the carriage comprises a horizontal carriage panel and wherein, in the deployed configuration, the carriage panel and the desk surface are substantially flush.

4. The workstation as claimed in claim 1, wherein the carriage comprises a horizontal carriage panel leaving less than a 2 cm gap from the front panel.

5. The workstation as claimed in claim 1, wherein, when the workstation transitions to the deployed configuration, the front panel pivots downwardly.

6. The workstation as claimed in claim 5, wherein, the front panel is restrained from pivoting downwardly until the carriage is substantially at an upper position.

7. The workstation as claimed in claim 5, wherein, the front panel is restrained from pivoting downwardly until the carriage is substantially at an upper position by side rails which engage outer surfaces of the front panel to keep the front panel vertical as the front panel moves vertically and wherein the side rails have upper ends which stop short from an upper position of the front panel.

8. The workstation as claimed in claim 1, further comprising flat side supports, which:

lie flat in against an outer surface of the front panel in the stowed configuration; and pivot outwardly to be orthogonal to an undersurface of the front panel in the deployed configuration to brace against respective side pillars.

9. The workstation as claimed in claim 8, wherein the side supports comprise protrusions which slot into slots of the side pillars.

10. The workstation as claimed in claim 1, wherein the side pillars are supported by feet and wherein the workstation further comprises extendable legs between the side pillars so that, in the deployed configuration, the workstation is further configurable in:

a seated configuration wherein the desk surface is at a seated position; and a standing configuration wherein the desk surface is at a standing position higher than the seated position.

11. The workstation as claimed in claim 10, wherein, in the standing configuration, the back panel is raised away from between the legs to allow space through the workstation.

12. The workstation as claimed in claim 1, wherein the top panel is pivotally coupled so that the top panel folds over the back of the workstation to lie flat against the back panel.

13. A stowable workstation comprising:

a back, top and front panels and side pillars;

the side pillars comprising a travelling upper portion and a fixed lower portion wherein the workstation is configurable:

in a stowed configuration wherein:

the panels and side pillars form a rectangular enclosure;

the travelling upper portions are at a lower position; and the front panel is vertical and transitions to a deployed configuration wherein:

the upper portions are configured to move vertically with respect to the fixed lower portions;

the front panel is configured to move up with the upper portions; and the front panel is configured to pivot outwardly, such that, in the deployed configuration;

the travelling upper portions are at an upper position;

the front panel extends horizontally to form a desk surface;

the top and back panels and upper portions define an open cabinet above the desk surface.

14. The workstation as claimed in claim 13, wherein, in the deployed configuration, the front panel is raised away from between the lower portions, thereby allowing leg space through a front of the workstation.

15. The workstation as claimed in claim 13, wherein, in the deployed configuration, the back panel is raised away from between the lower portions, thereby allowing leg space a rear of the workstation.

16. The workstation as claimed in claim 13, further comprising a cross brace between lower ends of the lower portions of the side pillars.

17. The workstation as claimed in claim 13, wherein, when the workstation transitions to the deployed configuration, the front panel travels upwardly with the upper portions and the front pivots downwardly.

18. The workstation as claimed in claim 17, further comprising front panel support legs pivotally coupled to the front panel and which lie flat against an outer surface of the front panel in the stowed configuration and extend orthogonally with respect to the front panel in the deployed configuration.

19. The workstation as claimed in claim 18, wherein the front panel support legs are pivotally coupled from the front panel by a distal pivot and pivotally coupled by braces at a proximal pivot point, the braces and pivot points configured so that, as the front panel pivots downwardly, the legs pivot orthogonally with respect to the front panel.

* * * * *